US010143290B2

(12) United States Patent
Burditt et al.

(10) Patent No.: US 10,143,290 B2
(45) Date of Patent: Dec. 4, 2018

(54) COMPACT WITH HIDDEN HINGE

(71) Applicant: HCT GROUP HOLDINGS LIMITED, Central (CN)

(72) Inventors: Stephen Burditt, Los Angeles, CA (US); Tania Miren Diaz, Santa Monica, CA (US); Stephen Chen, Los Angeles, CA (US)

(73) Assignee: HCT GROUP HOLDINGS LIMITED (HK)

( * ) Notice: Subject to any disclaimer, the term of this patent is extended or adjusted under 35 U.S.C. 154(b) by 0 days.

(21) Appl. No.: 15/918,452

(22) Filed: Mar. 12, 2018

(65) Prior Publication Data

US 2018/0263360 A1 Sep. 20, 2018

Related U.S. Application Data

(60) Provisional application No. 62/471,040, filed on Mar. 14, 2017.

(51) Int. Cl.

| | |
|---|---|
| ***B65D 43/26*** | (2006.01) |
| ***A45D 40/22*** | (2006.01) |
| ***A45D 33/00*** | (2006.01) |

(52) U.S. Cl.

CPC ..... *A45D 40/22* (2013.01); *A45D 33/008* (2013.01)

(58) Field of Classification Search

USPC ..... 206/581, 823; 220/843, 836, 847, 845, 220/263, 324; 132/293, 301, 303

See application file for complete search history.

(56) References Cited

U.S. PATENT DOCUMENTS

| | | | | |
|---|---|---|---|---|
| 4,746,031 | A | 5/1988 | Grandmottet | |
| 4,880,139 | A | 11/1989 | Jumel et al. | |
| 5,050,623 | A * | 9/1991 | Yuhara | A45C 13/1084 132/293 |
| 5,896,866 | A * | 4/1999 | Quennessen | A45C 13/008 132/293 |
| 6,526,989 | B2 | 3/2003 | Sheffler et al. | |
| 6,772,899 | B2 | 8/2004 | Delmon | |
| 8,356,952 | B2 * | 1/2013 | Bennett | A45D 34/041 132/293 |
| 2005/0231835 | A1 * | 10/2005 | Tokushita | A45D 33/006 359/871 |
| 2006/0118455 | A1 * | 6/2006 | Milesi | A45D 33/006 206/581 |
| 2012/0055503 | A1 * | 3/2012 | Kuo | A45D 33/006 132/293 |
| 2016/0353857 | A1 | 12/2016 | Kim et al. | |

OTHER PUBLICATIONS

International Search Report and Written Opinion dated Jun. 25, 2018 for International Application No. PCT/US2018/021976.

* cited by examiner

*Primary Examiner* — Jacob K Ackun

(74) *Attorney, Agent, or Firm* — Seager, Tufte & Wickhem LLP

(57) ABSTRACT

A cosmetic container includes a base assembly configured to hold a cosmetic product, and a lid. The lid and the base assembly are pivotably coupled with a hinge assembly that is completely hidden when the lid is closed. The hinge assembly may be positioned and secured within a recess of the base assembly.

15 Claims, 6 Drawing Sheets

COMPACT WITH HIDDEN HINGE

RELATED APPLICATIONS

This application claims the benefit of and priority to U.S. Provisional Application Ser. No. 62/471,040 filed Mar. 14, 2017, titled COMPACT WITH HIDDEN HINGE, the entirety of which is incorporated herein by reference.

TECHNOLOGY FIELD

The present application relates generally to a cosmetic compact, and in particular, to a compact including a hidden hinge.

BACKGROUND

Vessels exist that are portable, convenient to use, and designed to contain cosmetic products for use. These types of portable vessels usually consist of a jar and lid, that when assembled together provide an effective barrier for containing the product. The jar and/or lid are typically made of a glass, a plastic, a metal, combinations of the foregoing, or the like, that when closed together create a seal that can contain the product. These jar and lid assemblies may typically be sealed by a thread fastening mechanism, a snap fastening mechanism, or a clamp fastening mechanism. Some assemblies, when fastened together, can compress an o-ring or a gasket interposed by the jar and the lid. Some assemblies include hinged compacts rather than separate jars and lids.

These vessels are used in the cosmetics and personal care industries for containing a product to be applied to a body. Exemplary products include creams, gels, loose or compressed powders, and various makeup products, such as lip balm, blush/rouge, tint, petroleum products, sunscreen, etc. Portable vessels have been developed to contain products in a compact and often substantially airtight assembly. These are often built with a plastic pot and a loose plastic lid that are housed by a protective shell. However, because these vessels have a loose lid, it is difficult to manage both the loose lid and the protective shell while applying the contained product to a body. Some vessels have addressed this problem by utilizing a hinge or a tether to keep the lid with the pot. Such is the case with traditional compacts. Although portable vessels and compacts exist, there remains a need for improved cosmetic containers.

SUMMARY

This disclosure provides design, material, manufacturing methods, and use alternatives for cosmetic packaging.

In a first example, a cosmetic container may comprise a cosmetic container comprising: a lid having a front edge and a rear edge, the lid including a hinge element attached along the rear edge of the lid, the hinge element including a back surface spaced apart from the rear edge of the lid by a curved portion; a base assembly including a base and a housing, the base having a bottom surface and one or more walls defining a cavity for holding a product, and a recess in the one or more walls disposed along a rear edge of the base, wherein the housing is disposed over the base, the housing having front and rear walls, side walls and a top surface, the top surface having an opening that is aligned with the cavity, wherein the top surface includes a rear top surface extending from a rear edge of the opening to the rear wall; wherein the hinge element of the lid is disposed within the recess and pivotably connected to portions of the one or more walls on the base to allow the lid to pivot relative to the base assembly between a closed position and an open position, wherein an entirety of the hinge element is disposed within the base assembly and not visible from outside the cosmetic container when the lid is in a closed position.

Alternatively or additionally to any of the examples above, in another example, the curved portion of the hinge element is visible when the lid is in an open position.

Alternatively or additionally to any of the examples above, in another example, the back surface and curved portion of the hinge element are fixed to the lid and fixed relative to each other.

Alternatively or additionally to any of the examples above, in another example, spacing between back surface of the hinge element and the rear edge of the lid in combination with a curve of the curved portion of the hinge element provides a recess configured to receive the rear top surface of the housing when the lid pivots from the closed position to the open position.

Alternatively or additionally to any of the examples above, in another example, the cosmetic container further comprises a first latching element disposed on the lid and a second latching element disposed on the base assembly.

Alternatively or additionally to any of the examples above, in another example, the cosmetic container further comprises a latch release mechanism disposed on the base assembly and attached to the second latching element, the latch release mechanism configured to disengage the first latching element from the second latching element.

The above summary of some example embodiments is not intended to describe each disclosed embodiment or every implementation of the present disclosure. The Figures, and Detailed Description, which follow, more particularly exemplify these embodiments.

BRIEF DESCRIPTION OF THE DRAWINGS

The foregoing and other aspects of the present invention are best understood from the following detailed description when read in connection with the accompanying drawings. For the purpose of illustrating the invention, there is shown in the drawings embodiments that are presently preferred, it being understood, however, that the invention is not limited to the specific instrumentalities disclosed. Included in the drawings are the following Figures.

DETAILED DESCRIPTION

Figure 1:
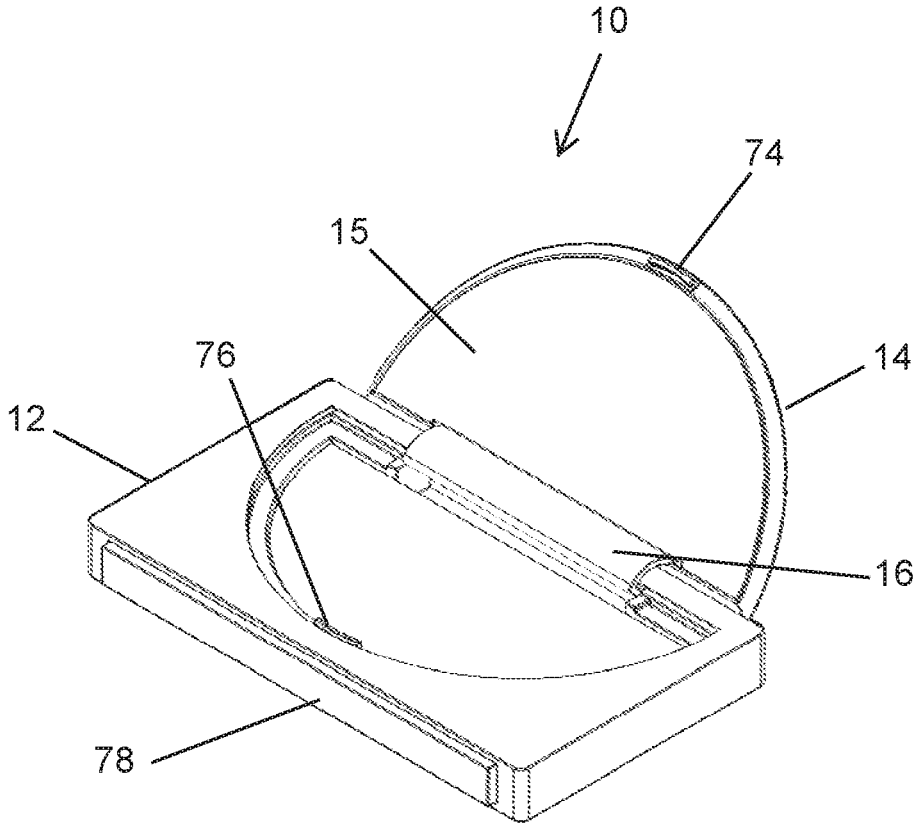
FIG. 1 is a perspective front view of an illustrative cosmetic container with a hidden hinge, with the lid in an open position.

FIG. 1 is a front perspective view of a cosmetic container 10 including a hidden hinge in an open configuration according to embodiments disclosed herein. As shown at FIG. 1, the cosmetic container 10 may include a base assembly 12 pivotably coupled to a lid 14. A mirror 15 may be disposed on the underside of the lid 14. The mirror 15 may be disposed within a recess in the lid 14 or the mirror may be attached to a flat lid, such as with adhesive. The base assembly 12 and the lid 14 may be pivotably coupled together via a hinge assembly 16. As will be described in more detail below, the lid 14 may be releasably secured to the base assembly 12 through a coupling between a first latch element 74 on the lid 14 and a second latch element 76 actuated by a button 78 disposed within the base assembly 12.

In some embodiments, the cosmetic container 10 and/or the various components thereof may be made from a rigid material (e.g., acrylonitrile butadiene styrene, thermoplastics, other polymers, glass, metal, alloy, wood, and the like). Other embodiments may, however, include containers 10 made from a flexible or semi-rigid material, such as plastic. In some embodiments, the base assembly 12 and/or lid 14 may comprise a transparent or translucent material so that the cosmetic product within may be externally viewed.

Figure 2A:
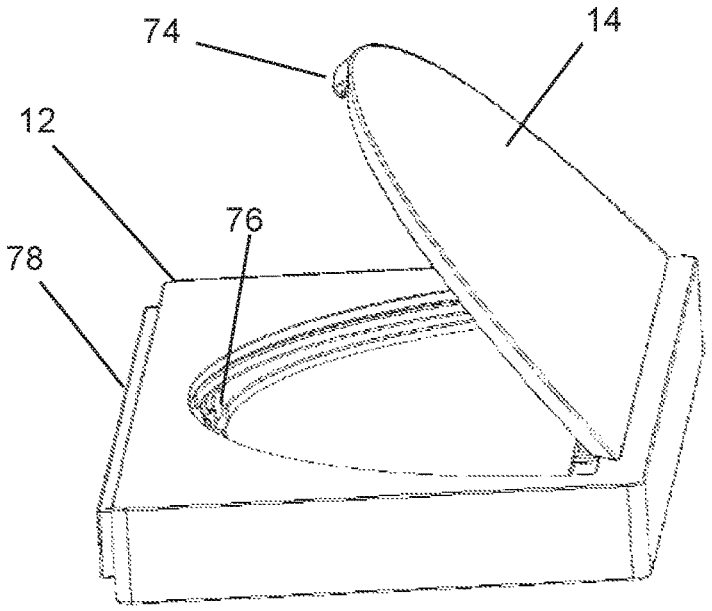
FIG. 2A is a perspective side view of the illustrative cosmetic container with a hidden hinge of FIG. 1, with the lid in a partially open position.
Figure 2B:
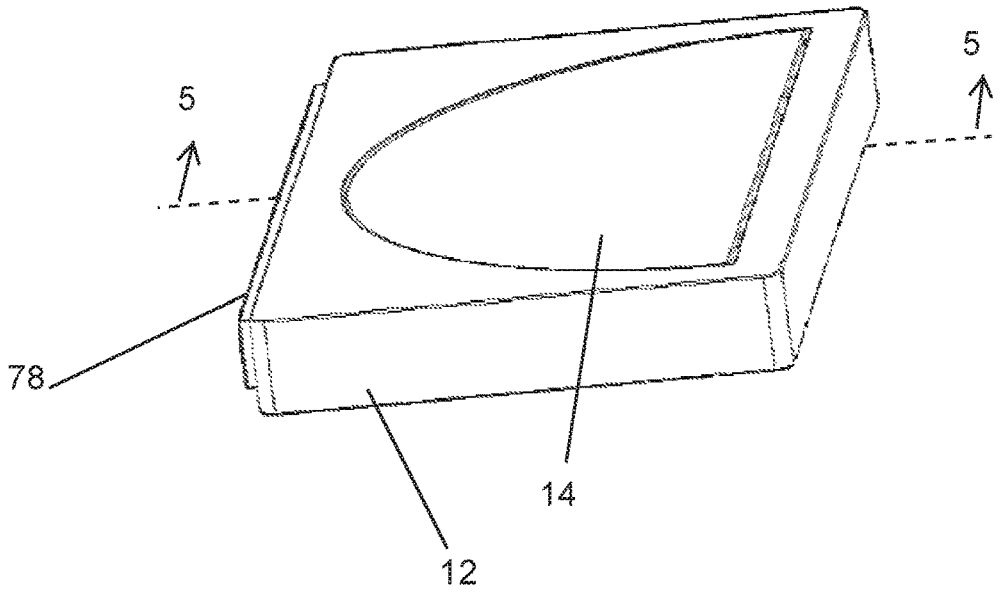
FIG. 2B is a perspective side view of the illustrative cosmetic container with a hidden hinge of FIG. 1, with the lid in a closed position.

FIGS. 2A and 2B are rear perspective views of the cosmetic container 10 with the lid 14 in a partially open (FIG. 2A) and a closed (FIG. 2B) configuration. While a portion of the hinge assembly 16 is visible inside when the lid is open, as seen in FIG. 1, the hinge assembly 16 is completely hidden from all sides in the closed configuration shown in FIG. 2B. The only mechanism visible when the lid 14 is closed is the button 78 that releases the first latch element 74 from the second latch element 76.

Figure 3:
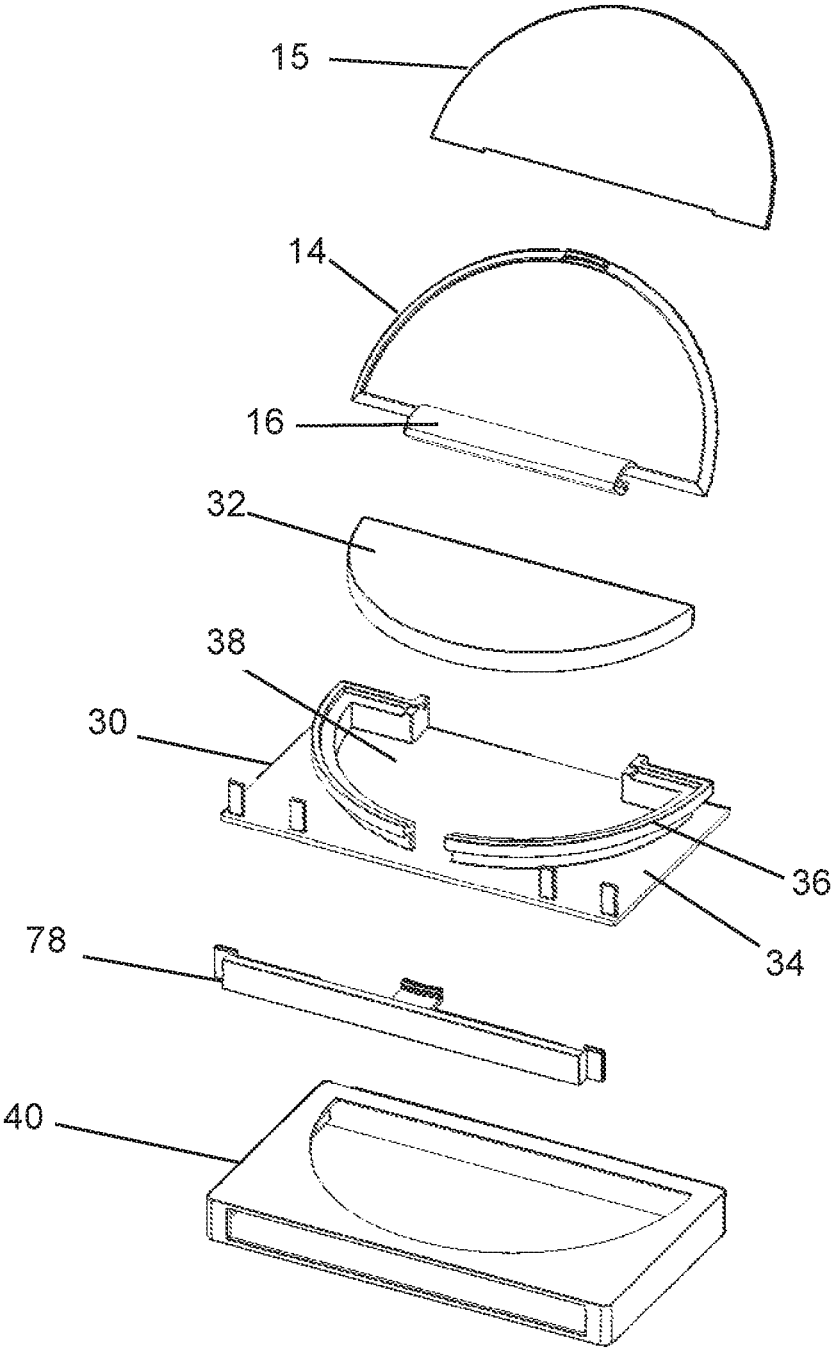
FIG. 3 is an exploded front view of the illustrative cosmetic container with a hidden hinge of FIG. 1, with the lid in an open position.

FIG. 3 is an exploded view showing all of the structures in the cosmetic container 10. The base assembly 12 may include one or more pots or compartments 32 at least partially encased by a base 30 and a housing 40. The base 30 may include a first, or bottom, surface 34 and one or more side walls 36 extending generally perpendicular to the bottom surface 34. The housing 40 receives the base 30 and defines the outer walls of the cosmetic container 10. The one or more compartments 32 may extend over less than the entire bottom surface 34, as shown in FIG. 3. In other examples, the one or more compartments 32 may extend over the entire bottom surface 34.

The one or more compartments 32 may be positioned within a cavity 38 formed at least in part by the bottom surface 34 and the one or more side walls 36. The one or more compartments 32 may be configured to receive a cosmetic product, such as, but not limited to loose powders (e.g., for eye, cheek, face, and the like), pressed powders (e.g., for eye, cheek, face, and the like), creams (e.g., skincare, eye, foundation, and the like), sunscreen, hot pour products (e.g., lipsticks, glosses, and the like), touchup, spot cover, baked powders, moisturizers, hair creams, gels, serums, and the like. While the base assembly 12 is illustrated as including one compartment 32, the base assembly 12 may include any number of compartments 32 desired, such as, but not limited to, one, two, three, four, or more. It is contemplated that the compartments 32 may be removable and/or interchangeable, as desired. In an alternative example, the base 30 may be configured with the sidewalls extending to fully surround a well, or several wells, for receiving cosmetic product(s) in puck form, rather than receiving a compartment 32.

Figure 4:
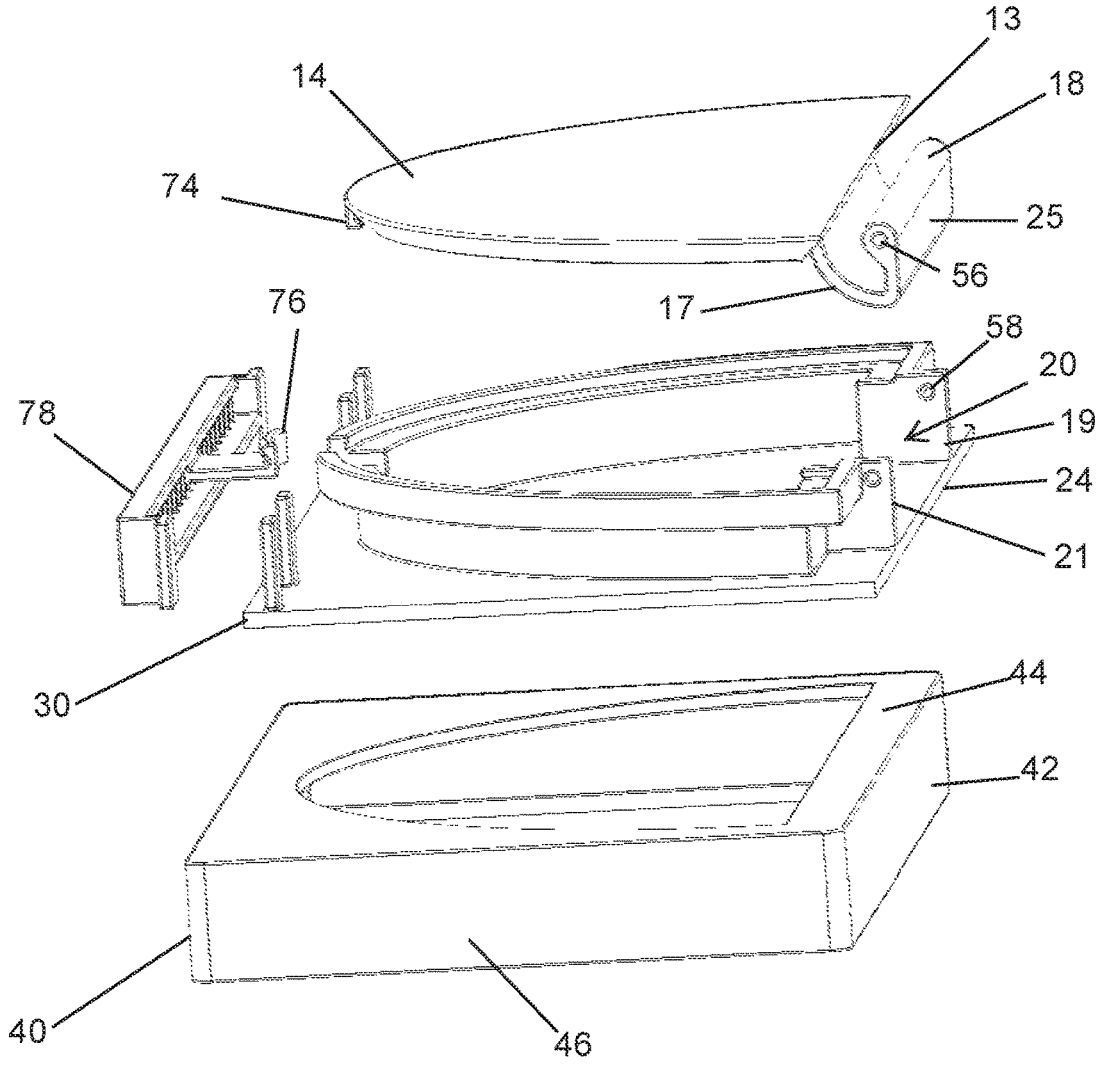
FIG. 4 is an exploded side view of the illustrative cosmetic container with a hidden hinge of FIG. 1, with the lid in a closed position.

In some embodiments, the hinge assembly 16 may include a bent hinge member 18 fixed to the lid 14, as shown in FIG. 4. The bent hinge member 18 is positioned within a recess 20 in the base 30 configured to receive a portion of the bent hinge member 18. The recess 20 may have a length extending from a first wall 19 to a second wall 21. The bent hinge member 18 may be positioned within the recess 20 such that a back surface 25 of the bent hinge member 18 is generally aligned with a rear edge surface 24 of the base 30. In other words, the hinge assembly 16 may be disposed within the recess 20 such that the back surface 25 of the hinge assembly 16 abuts the inner surface of the back wall 42 of the cover. The bent hinge member 18 may have apertures 56 on opposing ends that are aligned with apertures 58 on the first and second walls 19, 21 when the bent hinge member 18 is disposed within recess 20. Pins (not shown) may be used to connect apertures 56 with apertures 58, thereby pivotably mounting the lid 14 to the base 30.

When the lid 14 is mounted to the base 30, the back surface 25 of the bent hinge member 18 is aligned with the rear edge surface 24 of the base. The housing 40 includes a back wall 42, side walls 46, and a top rear surface 44. When the housing 40 is disposed over the base 30, the back wall 42, side walls 46, and top rear surface 44 of the housing 40 hide the bent hinge member 18 from view.

Figure 5A:
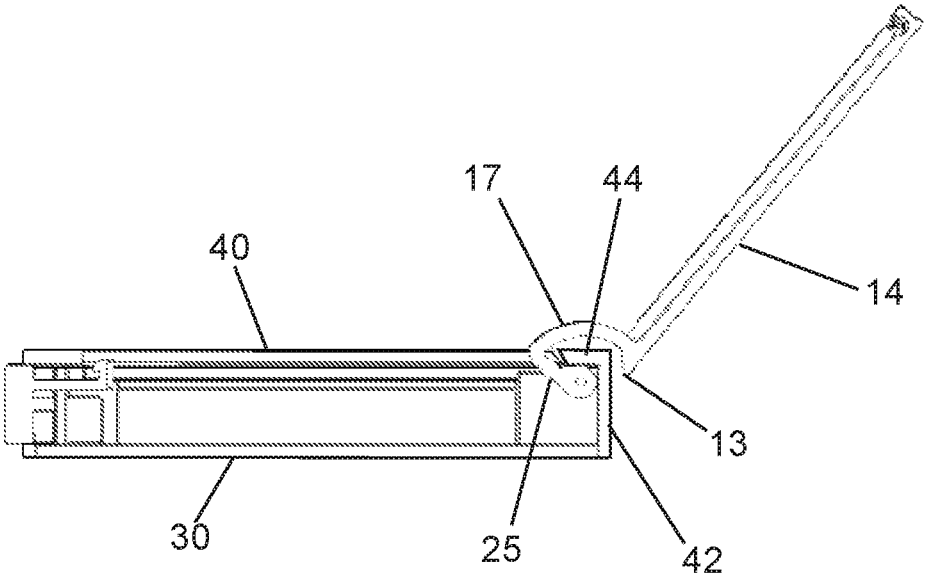
FIG. 5A is a side cross-sectional view taken through line 5-5 of FIG. 2B, with the lid in a fully open position.
Figure 5B:
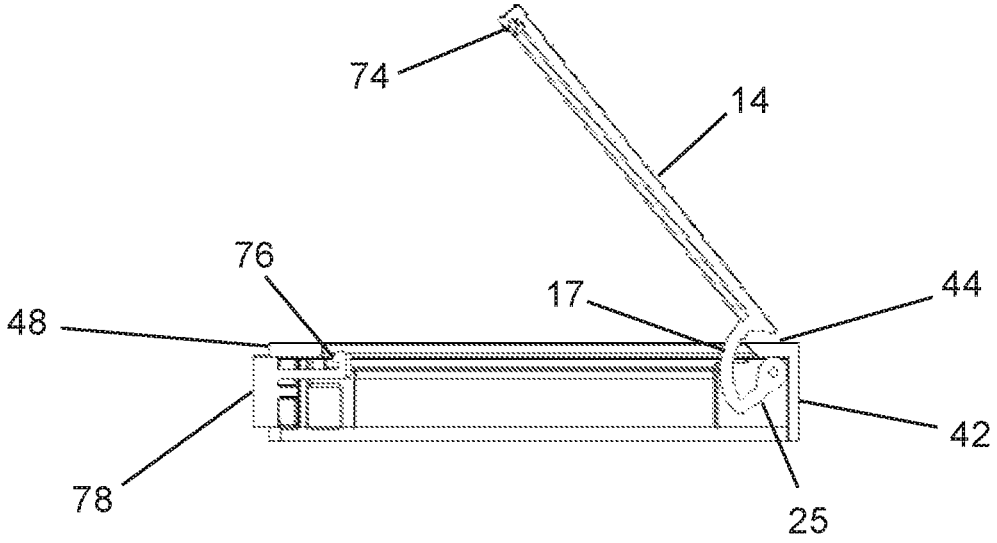
FIG. 5B is a side cross-sectional view taken through line 5-5 of FIG. 2B, with the lid in a partially open position.
Figure 5C:
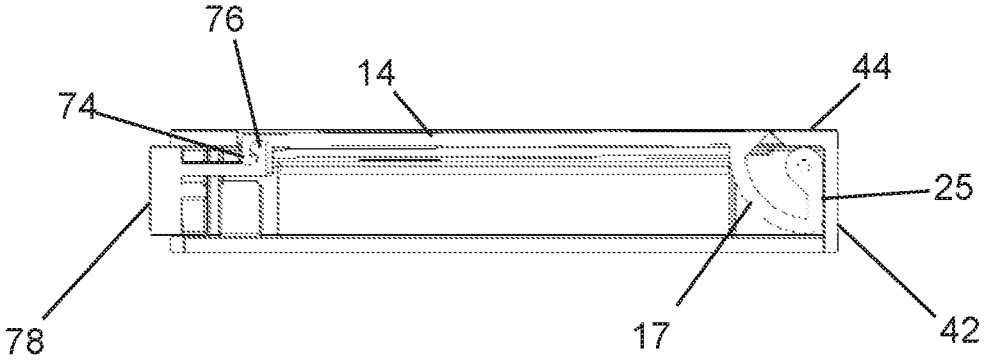
FIG. 5C is a side cross-sectional view taken through line 5-5 of FIG. 2B, with the lid in a closed position.

The back surface 25 of the bent hinge member 18 is connected to the lid 14 with a curved portion 17. The curved portion 17 spaces the back surface 25 away from the back edge 13 of the lid 14. This spacing allows the hinge assembly 16 to rotate around the top rear surface 44, as shown in FIGS. 5A, 5B, and 5C. FIG. 5A shows the cosmetic container 10 in cross section with the lid 14 in a fully open position. The curved portion 17 of the hinge assembly 16 and the spacing between the back surface 25 of the bent hinge member 18 and the back edge 13 of the lid 14 allows the lid 14 to fully open around the top rear surface 44 of the housing 40, while keeping the hinge assembly 16 hidden when the lid 14 is closed, and only allowing the curved portion 17 to be seen inside when the lid 14 is opened.

The interaction between the first latch element 74 on the lid 14 and the second latch element 76 attached to the button 78 are shown in FIGS. 5B and 5C. First latch element 74 includes a C shaped member with its opening facing the hinge assembly 16 when the lid 14 is in a closed position. Second latch element 76 includes a C shaped member with its opening facing the button 78. The button 78 is disposed in a front wall 48 of the housing 40 and is moveable slightly back and forth, towards and away from the back wall 42 of the housing 40. The button 78 is biased away from the back wall 42. In some examples, the button 78 is biased with a spring (not shown). In other examples, the button 78 is a thin member that flexes slightly when pushed towards the back wall 42 of the housing 40.

When the lid is closed, the first latch element 74 is pushed over and connects with the second latch element 76, thus holding the lid in the closed position. The lid is released by pushing the button 78 towards the back wall 42, this rearward motion of the button 78 moves the second latch element 76 just far enough backward to release the first latch element 74. The lid 14 may then be opened.

The compartment 32 and the lid 14 may each have a generally half-circular shape while the base assembly 12 may have a rectangular shape as illustrated. However, the compartment 32, base assembly 12 and the lid 14 may take any rotationally symmetrical shape (e.g. symmetric about the hinge assembly 16) desired, including but not limited to, square, rectangular, triangular, half-ovoid, polygonal, etc.

Although the invention has been described with reference to exemplary embodiments, it is not limited thereto. Those skilled in the art will appreciate that numerous changes and modifications may be made to the preferred embodiments of the invention and that such changes and modifications may be made without departing from the true spirit of the invention. It is therefore intended that the appended claims be construed to cover all such equivalent variations as fall within the true spirit and scope of the invention.

What is claimed is:

1. A cosmetic container comprising:

a lid having a front edge and a rear edge, the lid including a hinge element along the rear edge of the lid, the hinge element including a back surface spaced apart from the rear edge of the lid by a curved portion;

a base assembly including a base and a housing, the base having a bottom surface and one or more walls defining a cavity for holding a product, and a recess disposed along a rear edge of the base, wherein the housing is disposed over the base, the housing having front and rear walls, side walls and a top surface, the top surface having an opening that is aligned with the cavity, wherein the top surface includes a rear top surface extending from a rear edge of the opening to the rear wall;

wherein the hinge element of the lid is disposed within the recess and pivotably connected to the base to allow the lid to pivot relative to the base assembly between a closed position and an open position; and wherein an entirety of the hinge element is disposed within the base assembly and not visible from outside the cosmetic container when the lid is in a closed position.

2. The cosmetic container of claim 1, wherein the curved portion of the hinge element is visible when the lid is in an open position.

3. The cosmetic container of claim 2, wherein the back surface and curved portion of the hinge element are fixed to the lid and fixed relative to each other.

4. The cosmetic container of claim 1, wherein the back surface and curved portion of the hinge element are fixed to the lid and fixed relative to each other.

5. The cosmetic container of claim 1, wherein spacing between the back surface of the hinge element and the rear edge of the lid in combination with a curve of the curved portion of the hinge element provides a recess configured to receive the rear top surface of the housing when the lid pivots from the closed position to the open position.

6. The cosmetic container of claim 1, further comprising a first latching element disposed on the lid and a second latching element disposed on the base assembly.

7. The cosmetic container of claim 6, further comprising a latch release mechanism disposed on the base assembly and attached to the second latching element, the latch release mechanism configured to disengage the first latching element from the second latching element.

8. The cosmetic container of claim 1, wherein one or more compartments are positioned within the cavity of the base assembly, the one or more compartments configured to receive a cosmetic product.

9. The cosmetic compact of claim 1, wherein the hinge element of the lid is a bent hinge.

10. A cosmetic container comprising:

a lid having a front edge and a rear edge, the lid including a hinge element along the rear edge of the lid, the hinge element including a back surface spaced apart from the rear edge of the lid by a curved portion;

a base assembly including a base and a housing, the base having a bottom surface and one or more walls defining a cavity for holding a product, and a recess disposed along a rear edge of the base, wherein the housing is disposed over the base, the housing having front and rear walls, side walls and a top surface, the top surface having an opening that is aligned with the cavity, wherein the top surface includes a rear top surface extending from a rear edge of the opening to the rear wall;

a first latching element disposed on the lid and a second latching element disposed on the base assembly;

wherein the hinge element of the lid is disposed within the recess and pivotably connected to the base to allow the lid to pivot relative to the base assembly between a closed position and an open position; and wherein an entirety of the hinge element is disposed within the base assembly and not visible from outside the cosmetic container when the lid is in a closed position, and the curved portion of the hinge element is visible when the lid is in an open position.

11. The cosmetic container of claim 10, wherein spacing between the back surface of the hinge element and the rear edge of the lid in combination with a curve of the curved portion of the hinge element provides a recess configured to receive the rear top surface of the housing when the lid pivots from the closed position to the open position.

12. The cosmetic container of claim 10, further comprising a latch release mechanism disposed on the base assembly and attached to the second latching element, the latch release mechanism configured to disengage the first latching element from the second latching element.

13. The cosmetic container of claim 12, wherein the back surface and curved portion of the hinge element are fixed to the lid and fixed relative to each other.

14. The cosmetic compact of claim 13, wherein the hinge element is a bent hinge.

15. The cosmetic container of claim 10, wherein one or more compartments are positioned within the cavity of the base assembly, the one or more compartments configured to receive a cosmetic product.

* * * * *